US011121491B2

(12) United States Patent
Wang et al.

(10) Patent No.: US 11,121,491 B2
(45) Date of Patent: Sep. 14, 2021

(54) RECEPTACLE CONNECTOR FOR DETECTING CONNECTION STATES

(71) Applicant: SEIKO EPSON CORPORATION, Tokyo (JP)

(72) Inventors: Ke Wang, Azumino (JP); Nobuyuki Otsuki, Matsumoto (JP); Takashi Akahane, Azumino (JP); Masatoshi Tanaka, Azumino (JP); Takeshi Tamura, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/713,562

(22) Filed: Dec. 13, 2019

(65) Prior Publication Data

US 2020/0194917 A1 Jun. 18, 2020

(30) Foreign Application Priority Data

Dec. 14, 2018 (JP) ..... JP2018-234129

(51) Int. Cl.
*H01R 13/05* (2006.01)
*H01R 24/76* (2011.01)

(52) U.S. Cl.
CPC ..... *H01R 13/055* (2013.01); *H01R 24/76* (2013.01); *H01R 2201/18* (2013.01)

(58) Field of Classification Search
CPC ... H01R 13/055; H01R 24/76; H01R 2201/18
See application file for complete search history.

(56) References Cited

U.S. PATENT DOCUMENTS

2013/0065412 A1* 3/2013 Ikeda ..... H01R 13/62938 439/157
2016/0365685 A1* 12/2016 Lundbring ..... H01R 24/64
2017/0006250 A1 1/2017 Kusuda
2017/0123485 A1 5/2017 Imata
2019/0379150 A1* 12/2019 Turksu ..... H01R 31/02
2020/0194917 A1* 6/2020 Wang ..... H01R 13/055

FOREIGN PATENT DOCUMENTS

JP 2012-084951 A 4/2012
JP 2017-017515 A 1/2017
JP 2018-091920 A 6/2018

* cited by examiner

*Primary Examiner* — Abdullah A Riyami
*Assistant Examiner* — Nader J Alhawamdeh
(74) *Attorney, Agent, or Firm* — Dority & Manning, P.A.

(57) ABSTRACT

A receptacle connector includes a receptacle including an insertion port into which a plug is inserted, a lid configured to open and close the insertion port and maintain, while the plug is inserted into the insertion port, a state in which the lid is opened by the plug, and a switch configured to change over according to the opening and closing of the lid.

11 Claims, 8 Drawing Sheets

RECEPTACLE CONNECTOR FOR DETECTING CONNECTION STATES

The present application is based on, and claims priority from JP Application Serial Number 2018-234129, filed Dec. 14, 2018, the disclosure of which is hereby incorporated by reference herein in its entirety.

BACKGROUND

1. Technical Field

The present disclosure relates to a receptacle connector.

2. Related Art

JP A-2018-91920 (Patent Literature 1) discloses a projector that communicates with a communication apparatus via an Ethernet cable using a signal of an HDBaseT (registered trademark) standard. JP A-2012-84951 (Patent Literature 2) discloses a relay device that stops power supply to a communication section when communication with a base station is cut off.

In the technique of the HDBaseT standard, a processing device in an apparatus determines presence or absence of a communication link between apparatuses using communication data. Therefore, it is sometimes difficult to determine presence or absence of the communication link depending on a state of a partner apparatus.

SUMMARY

A receptacle connector according to an aspect of the present disclosure is a receptacle connector conforming to an HDBaseT standard, the receptacle connector including: a receptacle including an insertion port into which a plug is inserted; a lid configured to open and close the insertion port and maintain, while the plug is inserted into the insertion port, a state in which the lid is opened by the plug; and a switch configured to change over according to the opening and closing of the lid.

In the aspect, the receptacle connector may further include a spring configured to apply a force to the lid to close the lid.

In the aspect, the lid may have a surface curved along a side surface of a column having a center axis orthogonal to a direction in which the plug is inserted and rotate around the center axis to thereby open and close the insertion port.

In the aspect, a most closed state of the lid may be a half-open state.

DESCRIPTION OF EXEMPLARY EMBODIMENTS

Figure 1:
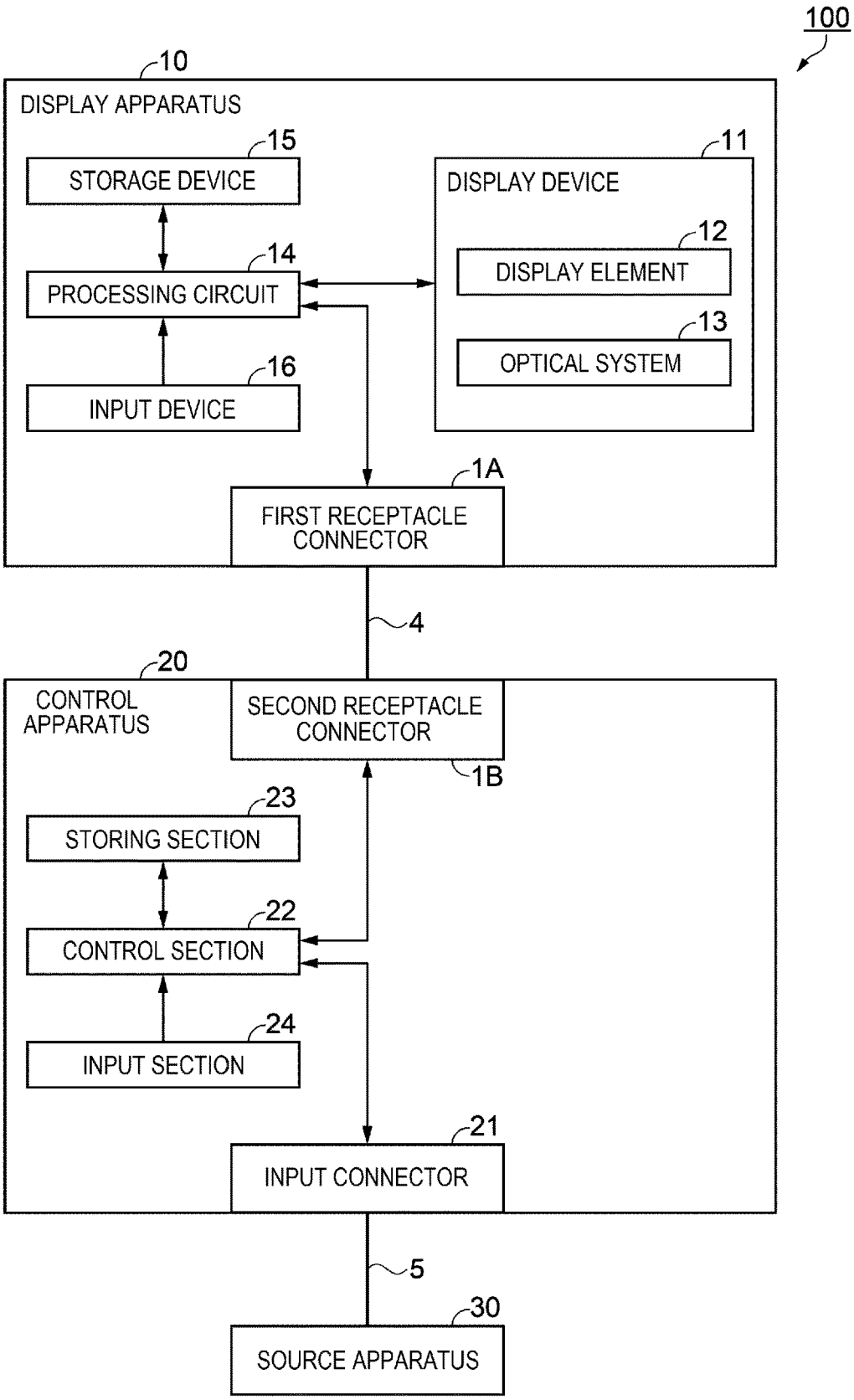
FIG. 1 is a block diagram for explaining the configuration of a communication system.

A receptacle connector according to an embodiment of the present disclosure is explained below with reference to the drawings. Not all of components explained in this embodiment are essential constituent elements of the present disclosure. The technical idea of the present disclosure does not limit the shapes, the structures, the disposition, and the like of the components to those explained below. In the drawings, the same or similar elements are respectively denoted by the same or similar reference numerals and signs and redundant explanation of the elements is omitted. The drawings are schematic and could be sometimes different from actual dimensions and relative ratios of the dimensions, disposition, structures, and the like.

Definitions of directions such as up and down, left and right, and the like in the following explanation are only definitions for convenience of explanation and do not limit the technical idea of the present disclosure. For example, it goes without saying that, if an observation target is rotated 90° around a visual line direction as an axis, it is understood that up and down is converted into left and right and left and right is converted into up and down and, if the observation target is rotated 180°, it is understood that up and down and left and right are respectively reversed. The technical idea of the present disclosure can be variously changed within the technical scope described in the appended claims.

Communication System

As shown in FIG. 1, each of a first receptacle connector 1A and a second receptacle connector 1B according to this embodiment can be applied to a communication system 100 including a display apparatus 10 and a control apparatus 20. The communication system 100 includes, for example, in addition to the display apparatus 10 and the control apparatus 20, a cable 4 that couples the display apparatus 10 and the control apparatus 20, a source apparatus 30, and a source cable 5 that couples the control apparatus 20 and the source apparatus 30.

The source apparatus 30 is an apparatus that outputs, for example, a signal conforming to an HDMI (registered trademark) standard, that is, an HDMI signal. Examples of the source apparatus 30 includes a personal computer, a movie player, and a game machine. The source cable 5 is, for example, an HDMI cable for the HDMI signal.

The control apparatus 20 is an HDBaseT transmitter that generates, based on the HDMI signal input from the source apparatus 30, an HDBaseT signal conforming to an HDBaseT (registered trademark) standard and transmits the HDBaseT signal to the display apparatus 10. That is, each of the display apparatus 10 and the control apparatus 20 is an apparatus conforming to the HDBaseT standard. The control apparatus 20 includes, in addition to the second receptacle connector 1B, an input connector 21, a control section 22, a storing section 23, and an input section 24. The input connector 21 is a connector into which a plug of the source cable 5 is inserted.

The control section 22 is configured from one or a plurality of processing circuits that can include, for example, a processing device such as a central processing unit (CPU) and circuit components. The control section 22 configures a computer system that processes an arithmetic operation necessary for the operation of the control apparatus 20. The control section 22 executes, for example, various programs stored in the storing section 23 to thereby realize functions of the control apparatus 20. The control section 22 generates, for example, an HDBaseT signal including the image signal included in the HDMI signal input from the input connector 21 and an apparatus control signal and outputs the HDBaseT signal to the second receptacle connector 1B.

The storing section 23 is a computer-readable storage medium such as a semiconductor memory. The storing section 23 stores programs of a series of processing and various data necessary for the operation of the control section 22. The storing section 23 is not limited to a nonvolatile auxiliary storage device and can include a volatile main storage device such as a register incorporated in the CPU.

The input section 24 outputs a signal corresponding to input operation of a user to the control apparatus 20. As the input section 24, for example, a push button, a touch sensor, and the like can be adopted.

The display apparatus 10 is, for example, a projector that displays an image on a screen based on the HDBaseT signal input from the control apparatus 20 via the cable 4. The display apparatus 10 includes, in addition to the first receptacle connector 1A, a display device 11, a processing circuit 14, a storage device 15, and an input device 16.

The display device 11 includes a display element 12 and an optical system 13. The display element 12 is, for example, a light modulating element such as a liquid crystal panel including a plurality of pixels. The optical system 13 includes, for example, optical elements such as a light source, a lens, and a mirror. The display element 12 modulates, according to control by the processing circuit 14 based on an image signal, light emitted from the light source of the optical system 13. The display device 11 projects the light passed through the display element 12 onto the screen using the optical system 13 to thereby display, on the screen, an image corresponding to the image signal input to the control apparatus 20.

The processing circuit 14 is configured from one or a plurality of processing circuits that can include, for example, a processing device such as a CPU and circuit components. The processing circuit 14 configures a computer system that processes an arithmetic operation necessary for the operation of the display apparatus 10. The processing circuit 14 executes, for example, various programs stored in the storage device 15 to thereby realize functions of the display apparatus 10. The processing circuit 14 generates, for example, from the image signal included in the HDBaseT signal input via the first receptacle connector 1A, a driving signal for driving the display element 12 and outputs the driving signal to the display element 12.

The storage device 15 is a computer-readable storage medium such as a semiconductor memory. The storage device 15 stores programs of a series of processing and various data necessary for the operation of the processing circuit 14. The storage device 15 is not limited to a nonvolatile auxiliary storage device and can include a volatile main storage device such as a register incorporated in the CPU.

The input device 16 outputs a signal corresponding to input operation of the user to the processing circuit 14. As the input device 16, for example, besides a general switch such as a push button, various pointing devices including a touch panel and a distance measurement sensor can be adopted.

For example, the display apparatus 10 has three kinds of power supply modes including a first mode, a second mode, and a third mode having power consumptions different from one another. The first mode is a mode having normal power consumption. In the first mode, the processing circuit 14 executes, for example, processing necessary for displaying an image on the screen. The second mode is a mode having power consumption smaller than the power consumption of the first mode and larger than the power consumption of the third mode. In the second mode, the processing circuit 14 determines, for example, presence or absence of input of an HDBaseT signal. The second mode is a so-called standby mode that can return to the first mode according to the input of the HDBaseT signal. The third mode is a mode having power consumption smaller than the power consumption of the second mode and larger than 0. The third mode is, for example, a so-called deep standby mode that cannot return to the first mode according to the HDBaseT signal.

For example, when the display apparatus 10 is turned on and an image signal is not input, the processing circuit 14 shifts the display apparatus 10 to the second mode. When a predetermined time T such as ten minutes elapses in the second mode, the processing circuit 14 shifts the display apparatus 10 to the third mode. Consequently, the display apparatus 10 can reduce power consumption. However, the processing circuit 14 does not shift the display apparatus 10 to the third mode while the cable 4 is coupled to the first receptacle connector LA. When the cable 4 is coupled to the first receptacle connector 1A during the third mode, the processing circuit 14 shifts the display apparatus 10 from the third mode to another mode.

Like the display apparatus 10, the control apparatus 20 can have a plurality of power supply modes. For example, the control apparatus 20 has a normal mode, a standby mode having power consumption smaller than power consumption of the normal mode, and a deep standby mode having power consumption smaller than the power consumption of the standby mode. In this case, the control section 22 does not shift the display apparatus 10 to the deep standby mode while the cable 4 is coupled to the second receptacle connector 1B. For example, when the cable 4 is coupled to the second receptacle connector 1B during the third mode, the control section 22 shifts from the third mode to another mode.

Receptacle Connector

Figure 2:
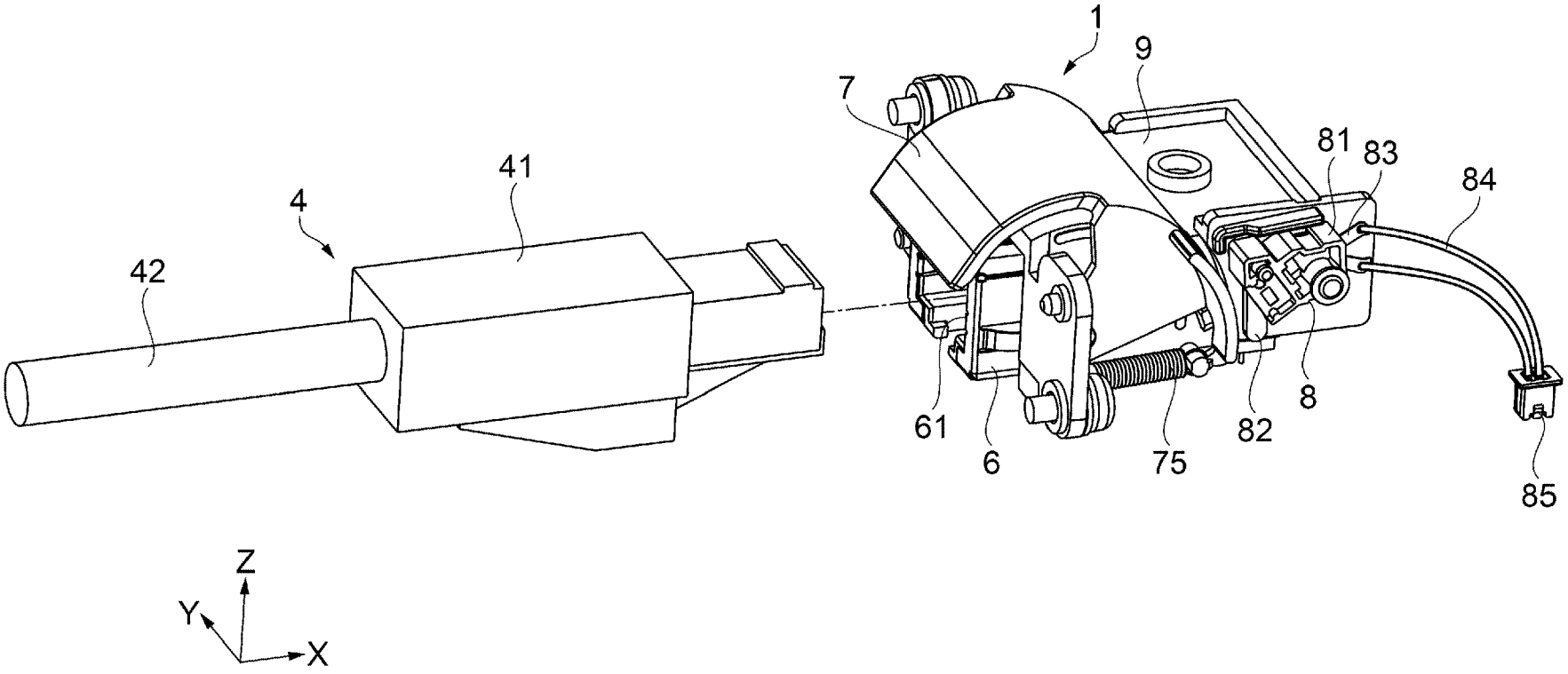
FIG. 2 is a perspective view for explaining a receptacle connector according to an embodiment.

As shown in FIG. 2, the receptacle connector 1 according to this embodiment includes a receptacle 6 including an insertion port 61 into which a plug 41 of the cable 4 is inserted, a lid 7 that opens and closes the insertion port 61, and a switch 8 that changes over according to the opening and closing of the lid 7. Each of the first receptacle connector 1A and the second receptacle connector 1B shown in FIG. 1 has the same structure as the structure of the receptacle connector 1 shown in FIG. 2. In the following explanation, one of the first receptacle connector 1A and the second receptacle connector 1B is explained simply as a receptacle connector 1.

The receptacle connector 1 conforms to the HDBaseT standard. Accordingly, the cable 4 is a so-called LAN (Local Area Network) cable configured from the plug 41 conforming to an RJ45 (8P8C) standard and a twisted pair cable 42 of a standard of a category 5, a category 6, or a higher category coupled to the plug 41.

The receptacle connector 1 further includes a spring 75 that applies a force to the lid 7 to close the lid 7 and a frame 9 to which the receptacle 6, the lid 7, the switch 8, and the spring 75 are attached. In a state in which the plug 41 is not inserted into the insertion port 61, the lid 7 is closed by the spring 75. On the other hand, the lid 7 needs to be opened in order to insert the plug 41 into the insertion port 61. The lid 7 maintains, while the plug 41 is inserted into the insertion port 61, a state in which the lid 7 is opened by the plug 41.

The switch 8 includes a main body 81 fixed to the frame 9, a lever 82 that moves according to the opening and closing of the lid 7, a pair of switch terminals 83, a switch wire 84 coupled to the switch terminals 83, and a switch connector 85 coupled to the switch wire 84. The main body 81 includes, on the inner side, a pair of contacts (not shown in FIG. 2) that are opened and short-circuited according to the movement of the lever 82. The pair of switch terminals 83 are respectively electrically coupled to the pair of contacts of the main body 81. Consequently, the pair of switch terminals 83 are opened and short-circuited according to the movement of the lever 82. The switch 8 may include, between the pair of switch terminals 83, a resistor that is coupled in series when the contacts are closed.

The switch wire 84 is configured from two lead wires that couple the pair of switch terminals 83 and the switch connector 85. For example, the switch connector 85 of the first receptacle connector 1A is directly coupled to the processing circuit 14. On the other hand, the switch connector 85 of the second receptacle connector 1B is directly coupled to the control section 22.

Figure 3:
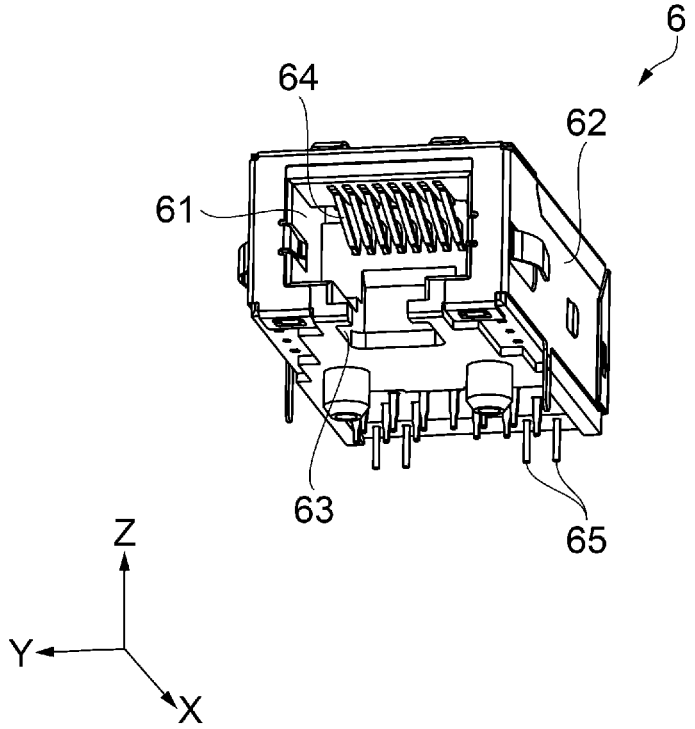
FIG. 3 is a perspective view for explaining a receptacle.

As shown in FIG. 3, the receptacle 6 includes a housing 62 schematically having a rectangular parallelepiped shape, a cutout section 63 provided at the peripheral edge portion of the insertion port 61, eight jack-side pins 64 provided on the inner side of the insertion port 61, and eight receptacle terminals 65 respectively coupled to the jack-side pins 64. The receptacle 6 conforms to the HDBaseT standard. That is, the receptacle 6 is a jack confirming to the RJ45 (8P8C) standard.

The insertion port 61 is opened on one surface, that is, one surface, the normal direction of which is a −X direction in FIG. 3, of the housing 62. For example, the cutout section 63 is defined to correspond to a latch provided in the plug 41 in a region extending from the peripheral edge of the insertion port 61 to the bottom surface of the housing 62. The eight receptacle terminals 65 are respectively electrically coupled to the jack-side pins 64 on the inside of the housing 62 and provided to project on the bottom surface of the housing 62. The receptacle terminal 65 of the first receptacle connector 1A is joined to a not-shown circuit board of the display apparatus 10 to thereby be electrically coupled to the processing circuit 14. The receptacle terminal 65 of the second receptacle connector 1B is joined to a not-shown circuit board of the control apparatus 20 to thereby be electrically coupled to the control section 22.

Figure 4:
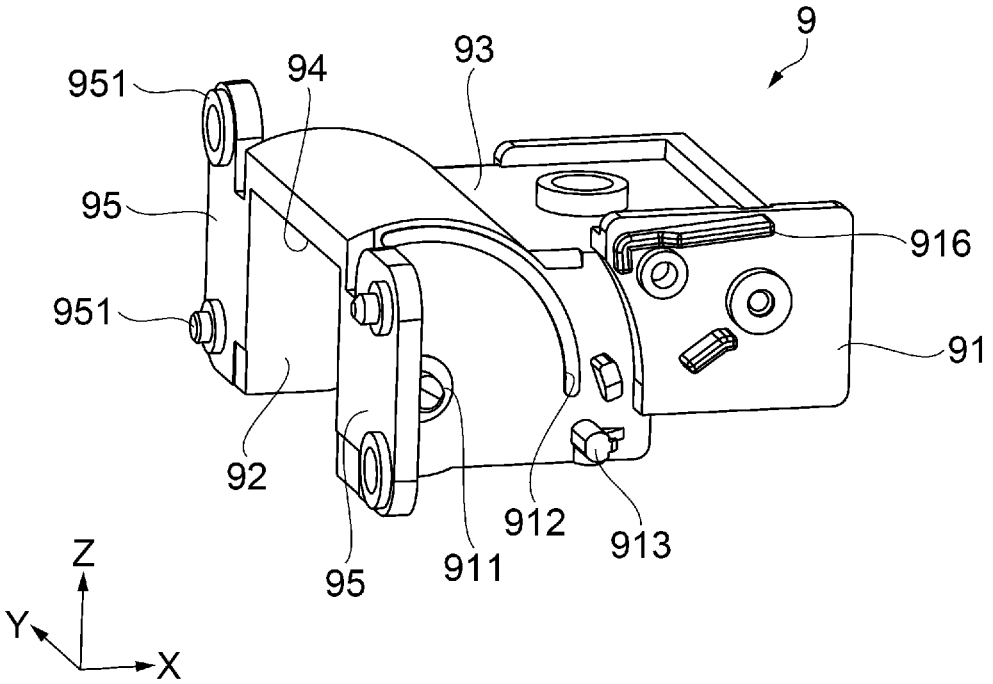
FIG. 4 is a perspective view for explaining a frame.

As shown in FIG. 4, the frame 9 includes a pair of side surface sections 91 and 92 and an upper surface section 93 that couples the side surface sections 91 and 92. The side surface sections 91 and 92 are disposed to be respectively opposed to two side surfaces of the housing 62 extending along an X-Z plane orthogonal to a Y axis in FIG. 3. The upper surface section 93 is coupled to the upper ends of the side surface sections 91 and 92. The frame 9 is relatively fixed to the receptacle 6 in a state in which the frame 9 is disposed to cover the receptacle 6 while exposing the insertion port 61 and the bottom surface of the housing 62. The frame 9 continuously exposes, in an opening section 94, the insertion port 61 and the bottom surface of the housing 62.

The upper surface section 93 curves to swell upward in a region further on the insertion port 61 side than the center to form a part of a side surface of a column having, as height, an interval between the side surface sections 91 and 92. The side surface sections 91 and 92 include a pair of flange sections 95 respectively provided at end portions on the insertion port 61 side and extending along a plane orthogonal to an X axis. The flange sections 95 are pierced through by a plurality of fixtures 951 including screws, machine screws, or bolts. The frame 9 can be fixed to a housing, an internal frame, or the like of the display apparatus 10 or the control apparatus 20 by the fixtures 951.

The side surface sections 91 and 92 include a pair of shaft sections 911 functioning as rotating shafts of the lid 7 and a pair of rail sections 912 functioning as guides for the rotating lid 7. In FIG. 4, illustration of the shaft section 911 and the rail section 912 of the side surface section 92 is omitted. The pair of shaft sections 911 and the pair of rail sections 912 can respectively have mirror symmetry to each other with respect to the X-Z plane. The pair of shaft sections 911 are columnar projecting sections provided along the Y axis respectively in the side surface sections 91 and 92. One side surface section 91 includes a first hook 913 to which one end of the spring 75 is fixed and an attachment section 916 to which the switch 8 is attached.

Figure 5:
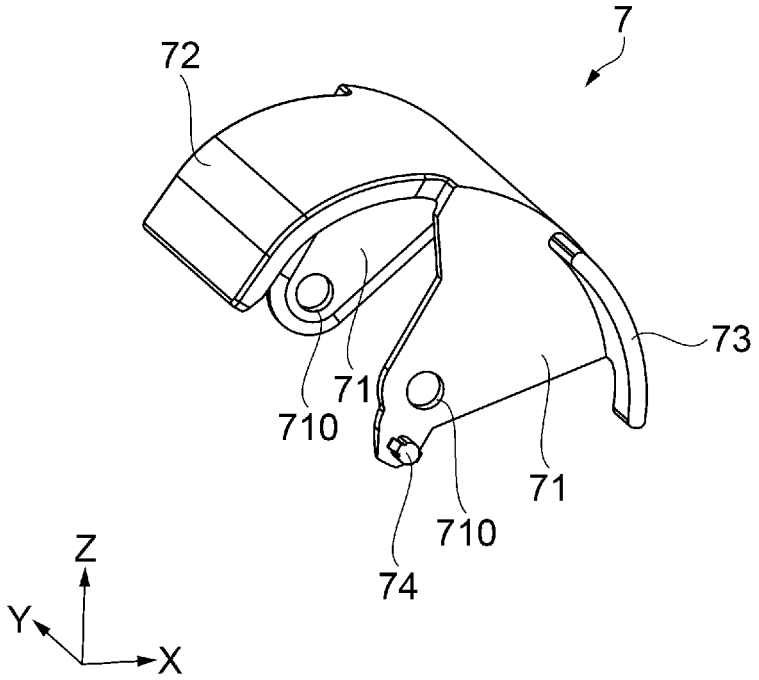
FIG. 5 is a perspective view for explaining a lid.

As shown in FIG. 5, the lid 7 includes a pair of holding plates 71 extending along a plane orthogonal to the Y axis, a shutter section 72 held by the pair of holding plates 71, and a contact section 73 that comes into contact with the lever 82 of the switch 8. The pair of holding plates 71 include a pair of shaft holes 710 into which the pair of shaft sections 911 are respectively inserted. The pair of shaft holes 710 are disposed along the Y axis. The pair of shaft sections 911 are inserted into the pair of shaft holes 710, whereby the lid 7 is attached to the frame 9. The lid 7 rotates around a rotation axis defined by the pair of shaft sections 911 to thereby open and close the insertion port 61.

The shutter section 72 has a surface curved along a side surface of a column having a center axis orthogonal to a direction in which the plug 41 is inserted, that is, an X direction. Specifically, the center axis of the column corresponding to the surface of the shutter section 72 coincides with the rotation axis of the lid 7 defined by the pair of shaft holes 710. Therefore, when the insertion port 61 is opened and closed, the height, that is, the dimension in a Z direction of the shutter section 72 does not change. In this way, the surface of the lid 7 curves to form a part of the side surface of the column having the center axis coinciding with the rotation axis. Therefore, the receptacle connector 1 can reduce an occupied space in the display apparatus 10 or the control apparatus 20. Note that the rotation axis of the lid 7 can pass through the insertion port 61 when viewed from a direction along the rotation axis.

Of the pair of holding plates 71, one holding plate 71 corresponding to the side surface section 91 includes a second hook 74 to which the other end of the spring 75 is fixed. The second hook 74 is located on the opposite side of a coupling portion to the shutter section 72 with respect to the shaft hole 710. Both the ends of the spring 75 are respectively caught by the first hook 913 and the second hook 74, whereby the spring 75 applies a force to the lid 7 in a direction in which the lid 7 is closed.

Figure 6:
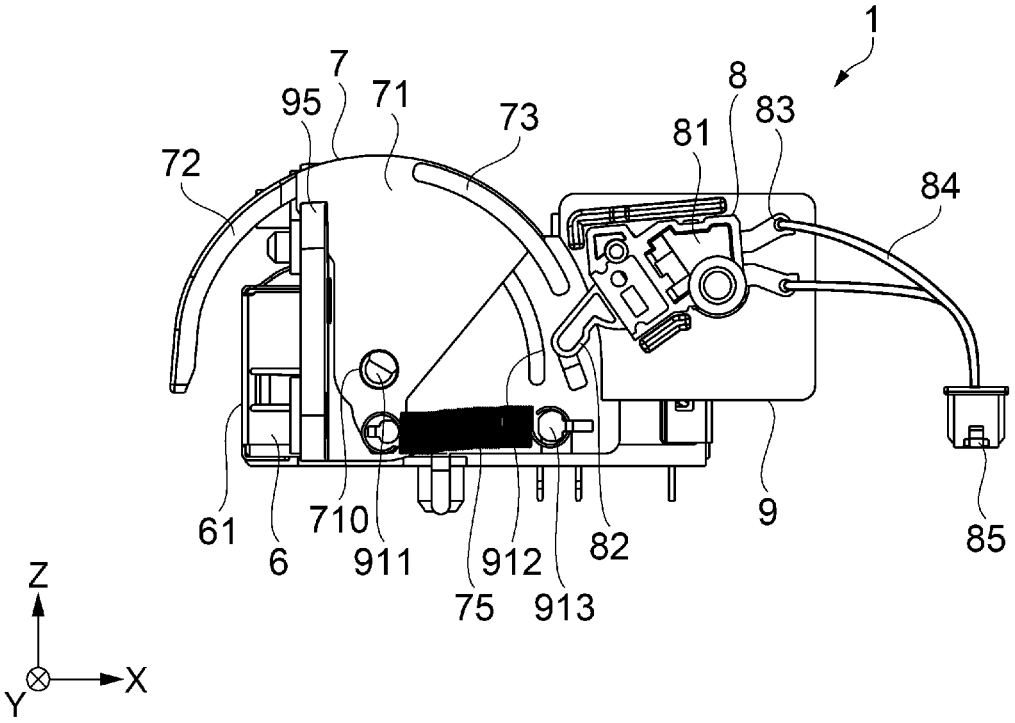
FIG. 6 is a side view of the receptacle connector in a state in which the lid is closed.

As shown in FIG. 6, the lid 7 is closed when the plug 41 is not inserted into the insertion port 61. Therefore, the contact section 73 does not come into contact with the lever 82. The lever 82 is in a normal position in a state in which the contact section 73 is not in contact with the lever 82. The pair of switch terminals 83 are opened while the lever 82 is in the normal position.

Figure 7:
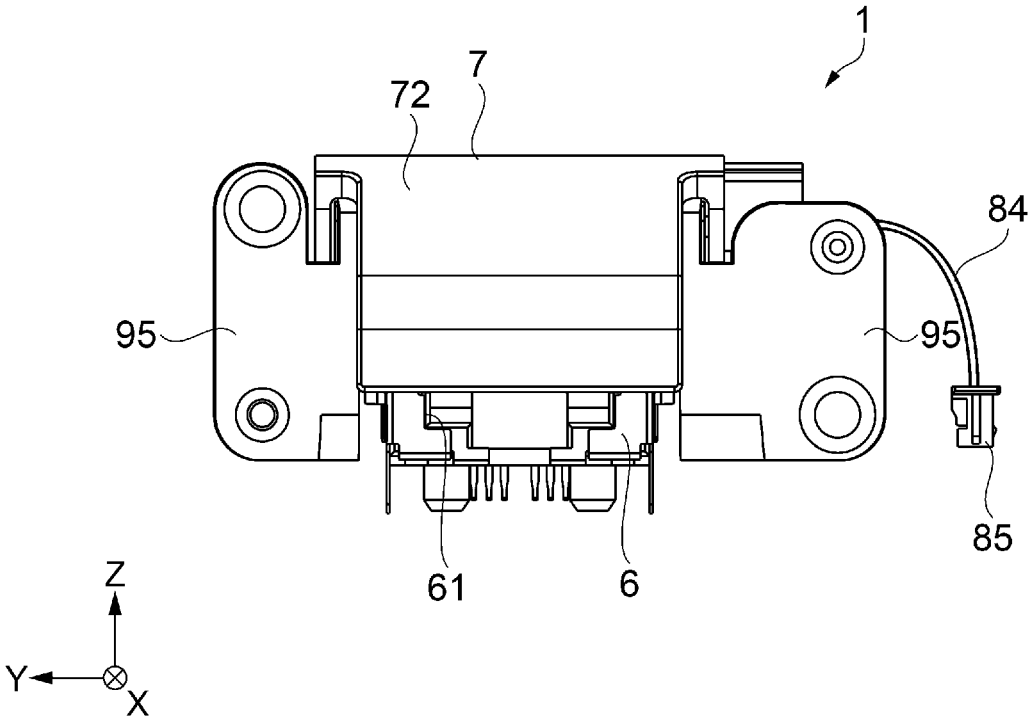
FIG. 7 is a front view of FIG. 6.

As shown in FIGS. 6 and 7, the lid 7 is closed by the spring 75 when the plug 41 is not inserted into the insertion port 61. In a state in which the end face of the holding plate 71 and the flange section 95 are in contact with each other to restrict the rotation of the lid 7, the lid 7 exposes a part of the insertion port 61 when viewed from the direction in which the plug 41 is inserted. That is, a most closed state of the lid 7 is a half-open state. Consequently, the user can directly insert the plug 41 into the insertion port 61 while pushing to open the shutter section 72 with one hand using the plug 41.

Figure 8:
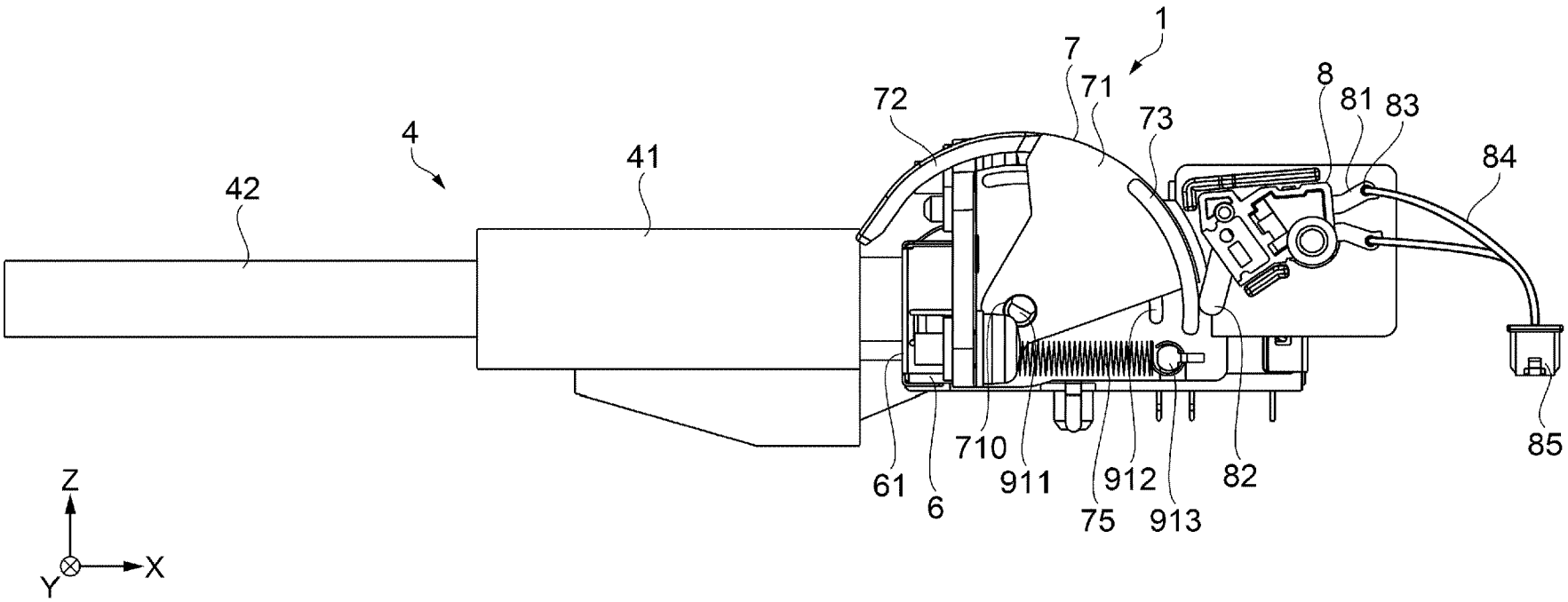
FIG. 8 is a side view of the receptacle connector in a state in which the lid is open.

As shown in FIG. 8, while the plug 41 is inserted into the insertion port 61, the lid 7 rotates around the rotation axis defined by the shaft section 911. Consequently, the contact section 73 pushes the lever 82 and displaces the lever 82 from the normal position. The pair of switch terminals 83 are short-circuited while the lever 82 is pushed by the contact section 73. The switch 8 is arranged such that the pair of contacts are switched based on a state in which the plug 41 is completely inserted into the insertion port 61.

The processing circuit 14 shown FIG. 1 can determine, according to the potential of the switch connector 85, whether the cable 4 is coupled to the first receptacle connector 1A. The switch connector 85 includes a signal terminal coupled to the processing circuit 14 to thereby be coupled to signal potential and a ground terminal coupled to ground potential. The signal terminal and the ground terminal are respectively coupled to the pair of switch terminals 83. The signal potential may be potential adjusted by a pull-up resistor. When the plug 41 is inserted into the insertion port 61, the switch 8 changes to a closed state. Therefore, the potential of the signal terminal changes to the ground potential. That is, while the potential of the signal terminal is the ground terminal, the processing circuit 14 determines that the cable 4 is coupled to the first receptacle connector 1A. In this way, the processing circuit 14 detects the potential of the signal terminal to thereby determine whether the cable 4 is coupled to the first receptacle connector 1A, that is, presence or absence of a communication link.

Similarly, the switch connector 85 of the second receptacle connector 1B includes a signal terminal coupled to the control section 22 to thereby be coupled to the signal potential and a ground terminal coupled to the ground potential. The control section 22 of the control apparatus 20 can determine, by detecting the potential of the signal terminal of the switch connector 85, whether the cable 4 is coupled to the second receptacle connector 1B. The control section 22 can determine, by detecting the potential of the signal terminal, whether the cable 4 is coupled to the second receptacle connector 1B, that is, presence or absence of a communication link.

Control Method for the Power Supply Modes

Figure 9:
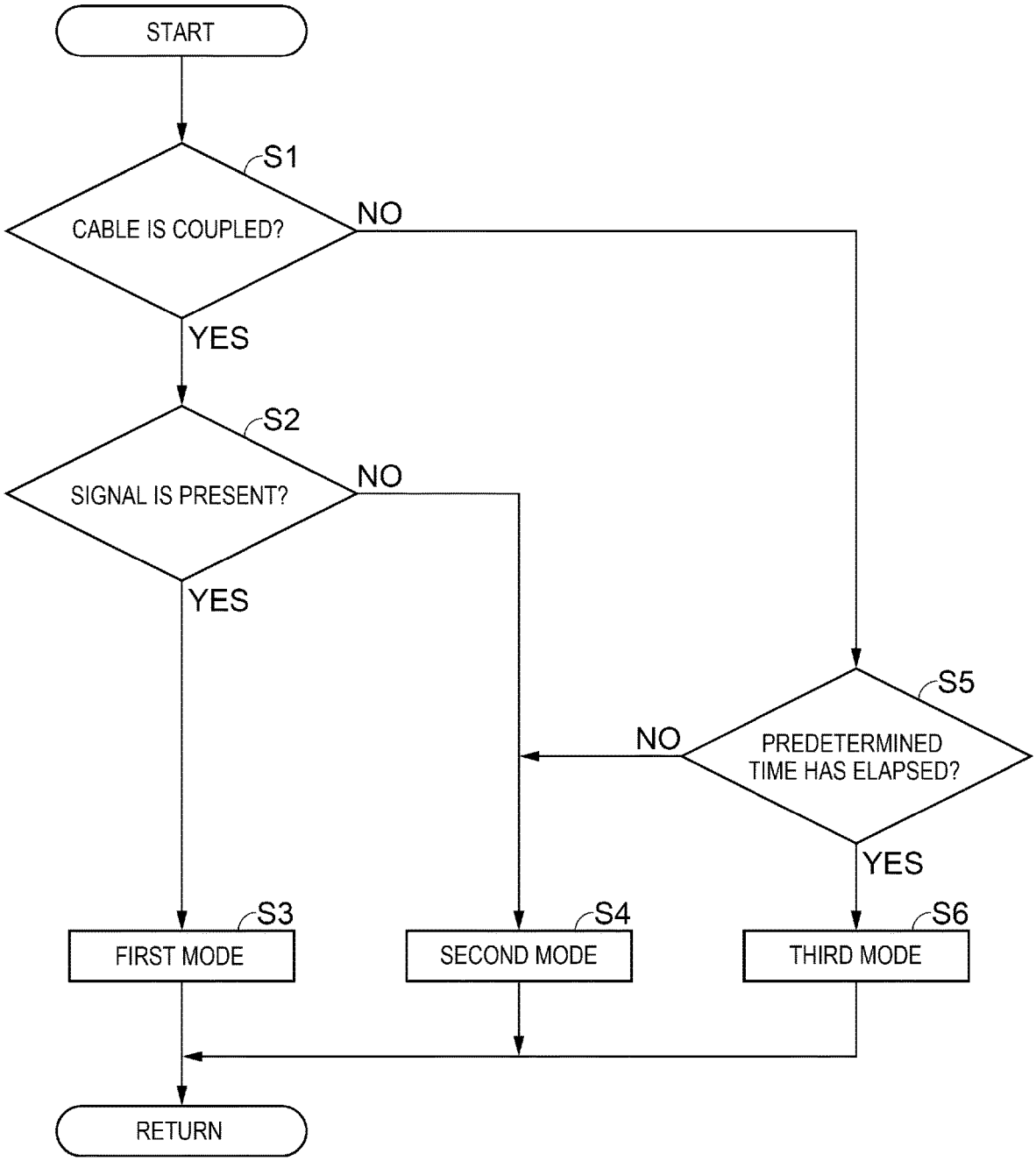
FIG. 9 is a flowchart for explaining a control method for power supply modes of a display apparatus.

An example of a control method for the power supply modes of the display apparatus 10 by the receptacle connector 1 according to this embodiment is explained with reference to a flowchart of FIG. 9. A series of processing of the flowchart of FIG. 9 is, for example, repeatedly executed at a predetermined cycle.

First, in step S1, the processing circuit 14 detects the potential of the signal terminal of the switch connector 85 to thereby determine whether the cable 4 is coupled to the first receptacle connector 1A. When the plug 41 is inserted into the insertion port 61, since the lid 7 is opened, the lever 82 is pushed by the contact section 73 and the switch 8 changes to the closed state. At this time, since the potential of the signal terminal is ground potential, the processing circuit 14 determines that the cable 4 is coupled and advances the processing to step S2. On the other hand, when the lid 7 is closed, since the switch 8 is in an open state, the potential of the signal terminal is the signal potential. In this case, the processing circuit 14 determines that the cable 4 is not coupled and advances the processing to step S5.

In step S2, the processing circuit 14 determines whether a signal is present in the cable 4 coupled to the first receptacle connector 1A. For example, when an HDBaseT signal is input to the receptacle 6 of the first receptacle connector 1A, the processing circuit 14 determines that a signal is present. When an image signal is present in the first receptacle connector LA, the processing circuit 14 advances the processing to step S3. When an image signal is absent, the processing circuit 14 advances the processing to step S4.

In step S3, the processing circuit 14 shifts the display apparatus 10 to the first mode. Consequently, the processing circuit 14 recognizes the image signal included in the HDBaseT signal input via the first receptacle connector 1A and causes the display device 11 to display an image indicated by the image signal. When the display apparatus 10 is already in the first mode, the processing circuit 14 maintains the first mode.

In step S4, the processing circuit 14 shifts the display apparatus 10 to the second mode. Consequently, the processing circuit 14 controls the sections of the display apparatus 10 such that the display apparatus 10 is driven with power consumption smaller than the power consumption of the first mode and larger than the power consumption of the third mode. When the display apparatus 10 is already in the second mode, the processing circuit 14 maintains the second mode.

In step S5, the processing circuit 14 determines whether the predetermined time T has elapsed from a point in time when the processing circuit 14 shifted the display apparatus 10 to the second mode. The predetermined time T is, for example, ten minutes. When the predetermined time T has elapsed after the processing circuit 14 shifted the display apparatus 10 to the second mode, the processing circuit 14 advances the processing to step S6. When the predetermined time T has not elapsed after the processing circuit 14 shifted the display apparatus 10 to the second mode, the processing circuit 14 advances the processing to step S4. For example, when the processing circuit 14 has not shifted the display apparatus 10 to the second mode yet in first step S5, the processing circuit 14 advances the processing to step S4.

In step S6, the processing circuit 14 shifts the display apparatus 10 to the third mode. Consequently, the processing circuit 14 controls the sections of the display apparatus 10 such that the display apparatus 10 is driven with power consumption smaller than the power consumption of the second mode. When the display apparatus 10 is already in the third mode, the processing circuit 14 maintains the third mode.

Figure 10:
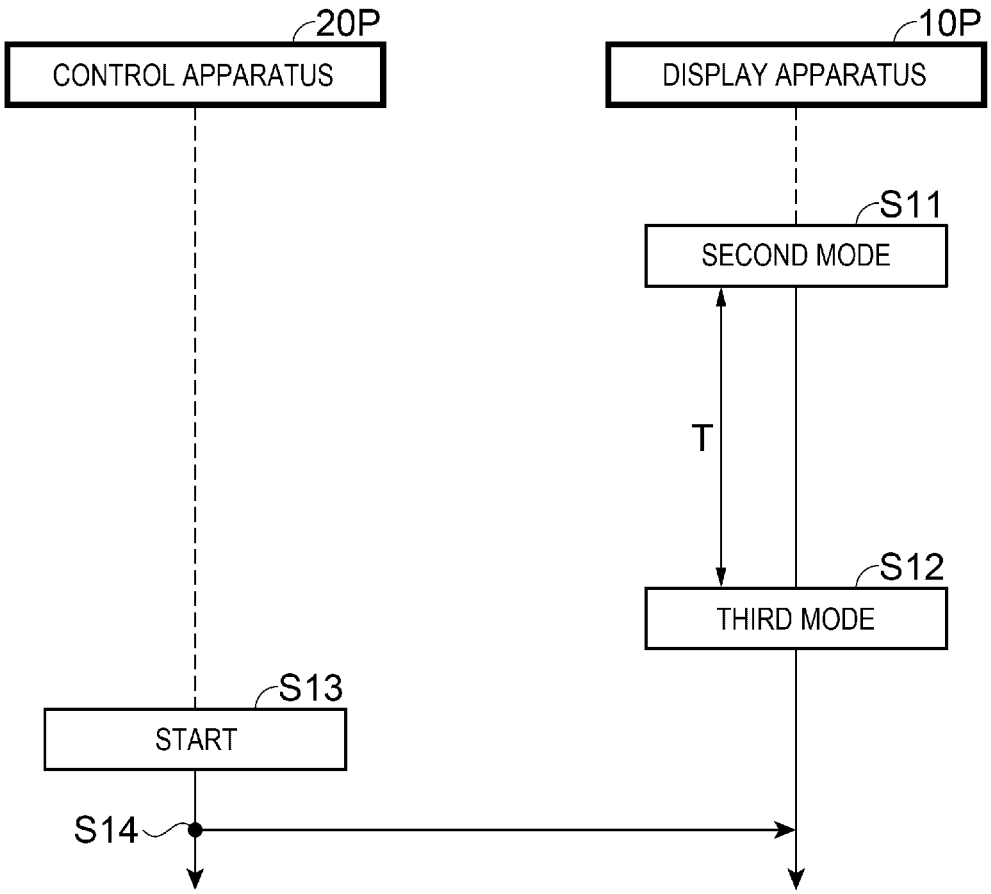
FIG. 10 is a sequence chart for explaining an example of the operation of a communication system not including the receptacle connector according to the embodiment.

As shown in FIG. 10, it is assumed that a control apparatus 20P, which is different from the control apparatus 20 in that the control apparatus 20P does not include the second receptacle connector 1B, transmits an HDBaseT signal to a display apparatus 10P, which is different from the display apparatus 10 in that the display apparatus 10P does not include the first receptacle connector 1A. However, in an initial state in which the display apparatus 10P is turned on, the display apparatus 10P is coupled to the control apparatus 20P, which is not turned on, via the cable 4.

At this time, the display apparatus 10P cannot receive the HDBaseT signal from the control apparatus 20P. Therefore, in step S11, the display apparatus 10P shifts to the second mode. Further, when the predetermined time T elapses after the display apparatus 10P shifts to the second mode while the control apparatus 20P is not turned on, in step S12, the display apparatus 10P shifts to the third mode. Thereafter, in step S13, the control apparatus 20P is turned on and starts. Subsequently, in step S14, according to operation of the user on the input section 24 of the control apparatus 20P, the control section 22 transmits an HDBaseT signal including an apparatus control signal to the display apparatus 10P. However, the processing circuit 14 of the display apparatus 10P does not recognize the HDBaseT signal in the third mode. Therefore, even if the display apparatus 10P receives the HDBaseT signal including the apparatus control signal from the control apparatus 20P, the display apparatus 10P does not perform operation corresponding to the apparatus control signal.

As a method with which the display apparatus 10P not including the first receptacle connector 1A determines presence or absence of a communication link with the control apparatus 20P, for example, there is a method of determining presence or absence of a communication link with the control apparatus 20P according to presence or absence of data of communication with the control apparatus 20P. However, for example, when the control apparatus 20P is not turned on or the control apparatus 20P is in the deep standby mode, the control apparatus 20P transmits no data to the display apparatus 10P. Accordingly, when the predetermined time T elapses after the display apparatus 10P shifts to the second mode, the display apparatus 10P shifts to the third mode in which the HDBaseT signal cannot be recognized. Therefore, the control apparatus 20P cannot control the display apparatus 10P using the apparatus control signal.

On the other hand, the first receptacle connector 1A according to this embodiment includes the switch 8 that changes over according to the opening and closing of the lid 7. Since the switch 8 is coupled to the processing circuit 14, the display apparatus 10 can easily determine, with power consumption smaller than power consumption for detecting the HDBaseT signal, whether the plug 41 is inserted into the insertion port 61, that is, presence or absence of a communication link. Consequently, when the plug 41 is inserted into the insertion port 61, the display apparatus 10 can determine that a communication link with the display apparatus 10 is present and perform operation for not shifting to the third mode. Accordingly, as long as the control apparatus 20 is coupled to the display apparatus 10 via the cable 4, it is possible to prevent a situation in which the display control apparatus 10 cannot be controlled by the apparatus control signal.

Further, the display apparatus 10 shifts to the third mode only when a communication link with the control apparatus 20 is absent. Therefore, it is possible to efficiently reduce power consumption while reducing a situation in which communication is impossible.

The flowchart of FIG. 9 can also be applied as a processing flow by the control section 22 of the control apparatus 20. In this case as well, the control section 22 can determine presence or absence of a communication link with the display apparatus 10 by detecting the potential of the signal terminal of the switch connector 85 of the second receptacle connector 1B. Consequently, for example, even when the display apparatus 10 transmits the HDBaseT signal including the apparatus control signal to the control apparatus 20 according to operation of the user on the input device 16, it is possible to prevent a situation in which the control apparatus 20 cannot be controlled by the apparatus control signal.

OTHER EMBODIMENTS

The embodiment is explained above. However, the present disclosure is not limited to the disclosure of the embodiment. The components of the sections may be replaced with any components having the same functions. Any components in the embodiment may be omitted or added within the technical scope of the present disclosure. In this way, various alternative embodiments become evident for those skilled in the art from the disclosure of the embodiment.

For example, in the embodiment explained above, the switch 8 may be configured to open the pair of switch terminals 83 in a state in which the lid 7 is opened and the plug 41 is inserted into the insertion port 61. In this case, when the lid 7 is closed, since the switch terminals 83 are short-circuited, the signal terminal of the switch connector 85 has the ground potential. The processing circuit 14 only has to determine according to a change of the signal terminal to the signal potential that the plug 41 is inserted into the insertion port 61 and the cable 4 is coupled.

The spring 75 of the receptacle connector 1 may be omitted. In this case, the lid 7 may be configured to close with the gravity when the plug 41 is removed from the insertion port 61. The lid 7 does not need to open and close the insertion port 61 by rotating and may open and close the insertion port 61 with, for example, a reciprocating linear motion. Further, the most closed state of the lid 7 does not need to be the half-open state and may be a state in which the lid 7 does not expose the insertion port 61 or the receptacle 6 when viewed from a direction in which the plug 41 is inserted or may be a state in which the lid 7 is completely closed from the outside of the housing.

Besides, it goes without saying that the present disclosure includes various embodiments not described above such as a configuration in which the configurations explained above are applied to one another. The technical scope of the present disclosure is decided only by the matters to define the invention according to the scope of the appended claims reasonable from the above explanation.

Contents derived from the embodiments are described below.

A receptacle connector is a receptacle connector conforming to an HDBaseT standard, the receptacle connector including: a receptacle including an insertion port into which a plug is inserted; a lid configured to open and close the insertion port and maintain, while the plug is inserted into the insertion port, a state in which the lid is opened by the plug; and a switch configured to change over according to the opening and closing of the lid.

With this configuration, an apparatus conforming to the HDBaseT standard can determine, by detecting a state of the switch included in the receptacle connector, whether the plug is inserted into the insertion port. Accordingly, the apparatus conforming to the HDBaseT standard can easily determine presence or absence of a communication link.

The receptacle connector may further include a spring configured to apply a force to the lid to close the lid.

With this configuration, the lid can be surely closed when the plug is removed from the insertion port. Therefore, the apparatus conforming to the HDBaseT standard can improve accuracy of determining presence or absence of a communication link.

In the receptacle connector, the lid may have a surface curved along aside surface of a column having a center axis orthogonal to a direction in which the plug is inserted and rotate around the center axis to thereby open and close the insertion port.

With this configuration, a change in dimensions at the time when the lid opens and closes the insertion port is reduced. Consequently, the receptacle connector can reduce an occupied space in the apparatus conforming to the HDBaseT standard.

In the receptacle connector, a most closed state of the lid may be a half-open state.

With this configuration, the user can directly insert the plug into the insertion port while pushing and opening the lid with one hand using the plug. Accordingly, the receptacle connector can reduce a burden on the user.

What is claimed is:

1. A receptacle connector conforming to an 8P8C standard, the receptacle connector comprising:

a receptacle including an insertion port into which a plug is inserted;

a lid configured to open and close the insertion port and maintain, while the plug is inserted into the insertion port, a state in which the lid is opened by the plug; and a switch configured to change a potential of a signal terminal according to the opening and closing of the lid, wherein the switch comprises a pair of contacts that are opened and short-circuited according to the opening and closing of the lid.

2. The receptacle connector according to claim 1, further comprising a spring configured to apply a force to the lid to close the lid.

3. The receptacle connector according to claim 1, wherein the lid has a surface curved along a side surface of a column having a center axis orthogonal to a direction in which the plug is inserted and rotates around the center axis to thereby open and close the insertion port.

4. The receptacle connector according to claim 1, wherein a most closed state of the lid is a half-open state.

5. The receptacle connector according to claim 1, wherein the pair of contacts comprise a ground contact and a signal contact, the signal contact being coupled to a first electrical potential and the ground contact being coupled to a second electrical potential, the first electrical potential being different than the second electrical potential.

6. The receptacle connector according to claim 1, comprising a lever that moves according to the opening and closing of the lid, wherein the pair of contacts are opened and short-circuited according to the movement of the lever.

7. The receptacle connector according to claim 6, wherein a section of the lid is configured to push the lever when the lid is in an open state.

8. The receptacle connector according to claim 6, wherein the lid is configured to rotate around a rotation axis to thereby open and close the insertion port, the rotation axis being orthogonal to a direction in which the plug is inserted; and wherein a section of the lid is configured to push the lever as the lid rotates around the center axis.

9. The receptacle connector according to claim 1, wherein the signal terminal is coupled to one of the pair of contacts.

10. The receptacle connector according to claim 1, wherein the switch is configured to change a potential of a signal terminal to a signal potential when the lid is closed and to a ground potential when the lid is opened.

11. The receptacle connector according to claim 10, wherein the signal potential is potential adjusted by a pull-up resistor.

* * * * *